United States Patent [19]

Shifferaw

[11] Patent Number: 5,039,088

[45] Date of Patent: Aug. 13, 1991

[54] EXERCISE MACHINE

[76] Inventor: Tessema D. Shifferaw, 1856 Carlson, Richmond, Calif. 94804

[21] Appl. No.: 514,587

[22] Filed: Apr. 26, 1990

[51] Int. Cl.[5] ..... A63B 21/00

[52] U.S. Cl. ..... 272/73; 272/72

[58] Field of Search ..... 272/70, 96, 97, 73, 272/71, 72; 74/594.1; 128/25 R

[56] References Cited

U.S. PATENT DOCUMENTS

| | | | |
|---|---|---|---|
| 1,977,235 | 10/1934 | Lofquist et al. | 74/594.1 |
| 3,759,511 | 9/1973 | Zinkin et al. | 272/70 |
| 4,625,962 | 12/1986 | Street | 272/97 |
| 4,659,077 | 4/1987 | Stropkay | 272/97 |
| 4,733,858 | 3/1988 | Lan | 272/Y |
| 4,830,362 | 5/1989 | Ball | 272/70 |
| 4,838,543 | 6/1989 | Armstrong et al. | 272/70 |

*Primary Examiner*—Stephen R. Crow
*Attorney, Agent, or Firm*—Flehr, Hohbach, Test, Albritton & Herbert

[57] ABSTRACT

Exercise machine which combines an up and down leg motion with a back and forth arm motion, with the arms and legs each providing resistance to the movement of the other. A pair of foot levers is pivotally mounted on a frame for up and down movement in a generally vertical direction, with pedals carried by the foot levers for engagement by the feet of a person using the machine. A pair of vertically extending hand levers is pivotally mounted on the frame for back and forth movement in a generally horizontal direction, with hand grips carried by the hand levers for engagement by the hands of the person using the machine. A pair of connecting rods interconnect the foot levers and the hand levers for movement in concert so that the arms and the legs of the person using the machine can resist movement of each other. Additional resistance is provided by a strap which is trained about a pulley and connected to the levers in one of the two pairs, with a brake for resisting rotation of the pulley.

12 Claims, 2 Drawing Sheets

EXERCISE MACHINE

This invention pertains generally to physical fitness and, more particularly, to an exercise machine.

Heretofore, a wide variety of exercise machines have been provided for exercising different parts of the human body. One very popular type of machine for exercising the legs and lower body is the so-called stationary bicycle in which a person pedals against a resistance which can, for example, be provided by a weighted flywheel and a braking mechanism engageable with the flywheel.

An improved version of the stationary bicycle has arm levers linked to the pedals to provide means for exercising the upper body and the arms as well as the lower body and the legs. A particularly popular machine of this type is the Schwinn Air-Dyne machine which has an energy absorbing wheel which displaces air as it rotates to provide the desired resistance. A machine of this type is illustrated in U.S. Pat. No. 4,757,988 (FIG. 11). Other machines having rotating foot pedals and reciprocating arm levers are found in U.S. Pat. Nos. 4,188,030, 4,509,742, 4,773,399, 4,824,102, 4,838,544, 4,844,451, 4,852,872 and 4,871,164.

U.S. Pat. No. 4,798,379 discloses a machine having a combination of foot driven treadles and arm operated levers connected to a vaned flywheel by drive belts.

U.S. Pat. Nos. 2,453,771, 2,603,486 and 4,645,200 disclose machines having hand grips and foot pedals at opposite ends of levers for reciprocating motion in opposite directions.

Another type of machine which has recently become popular is the so-called step machine. These machines have a pair of foot treadles which move up and down with a motion which approximates the motion of the feet in stepping.

The invention provides a new type of exercise machine which combines an up and down leg motion with a back and forth arm motion, with the arms and legs each providing resistance to the movement of the other. The machine has a pair of foot levers pivotally mounted on a frame for up and down movement in a generally vertical direction, pedals carried by the foot levers for engagement by the feet of a person using the machine, a pair of vertically extending hand levers pivotally mounted on the frame for back and forth movement in a generally horizontal direction, hand grips carried by the hand levers for engagement by the hands of the person using the machine, and a pair of connecting rods interconnecting respective ones of the foot levers and the hand levers for movement in concert so that the arms and the legs of the person using the machine can resist movement of each other. Additional resistance can be provided by a strap which is trained about a pulley and connected to the levers in one of the two pairs, with a brake for resisting rotation of the pulley.

Figure 1:
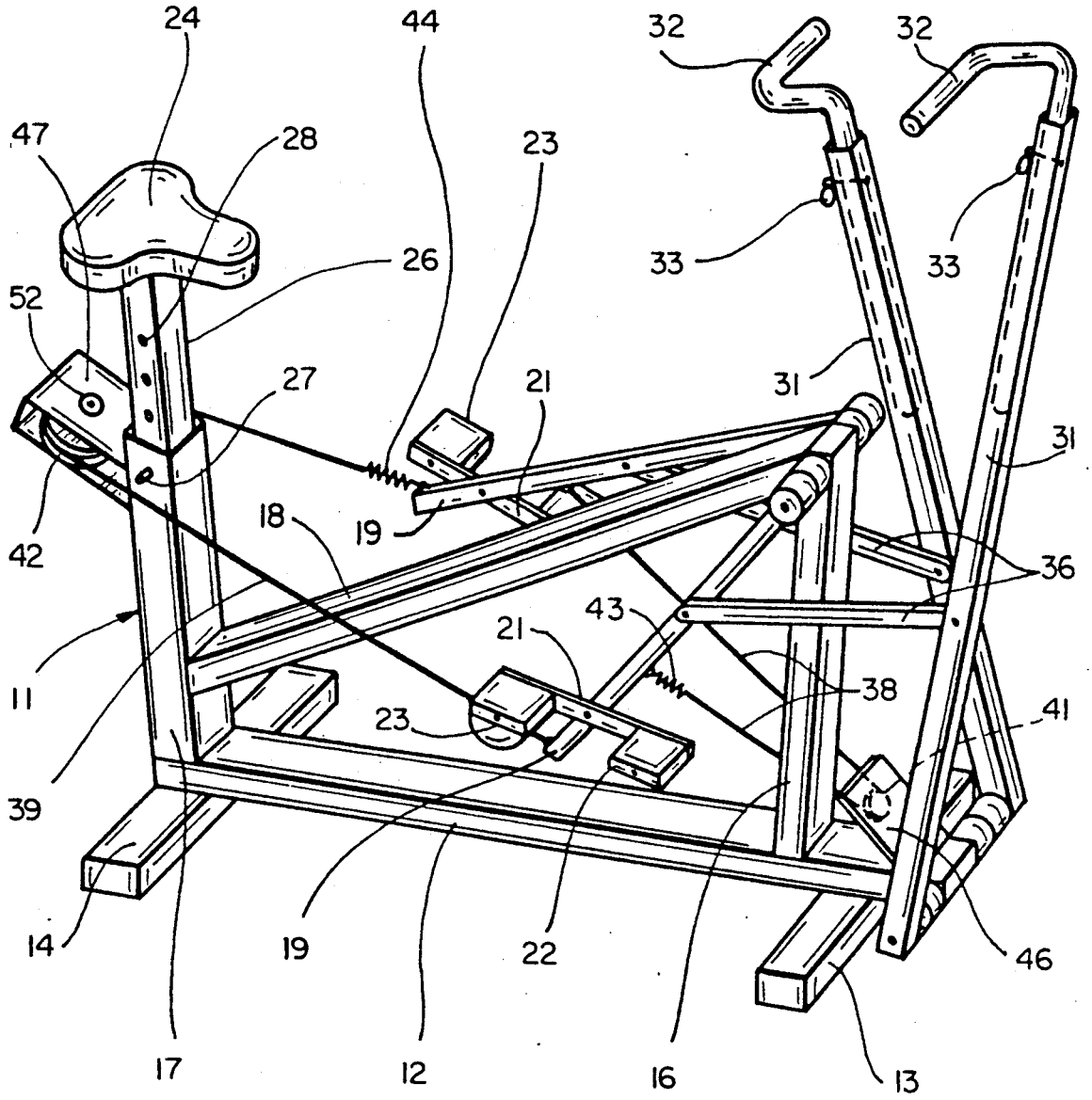
FIG. 1 is an isometric view of one embodiment of an exercise machine according to the invention.

As illustrated in FIG. 1, the exercise machine has a rigid frame 11 with a longitudinally extending base member 12 and a pair of laterally extending cross members or legs 13, 14 which are adapted to rest on the floor or other supporting surface. Front and rear posts 16, 17 extend in an upright direction from base member 12, and a brace 18 extends diagonally between the upper end of front post 16 and the lower portion of rear post 17.

A pair of foot levers 19 are pivotally mounted on the upper portion of front post 16 for up and down movement in a generally vertical direction. The pivots are located at the upper ends of the levers, and the levers extend downwardly and rearwardly from the post.

Figure 2:
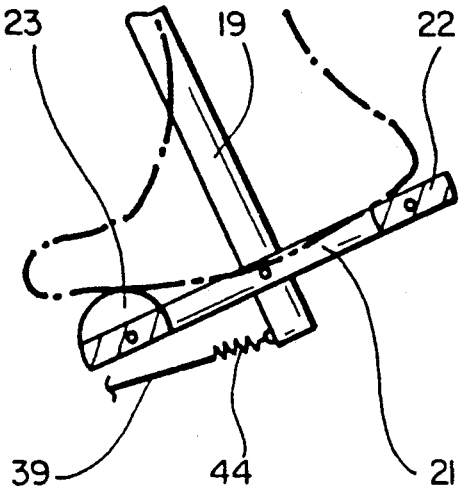
FIGS. 2 and 3 are fragmentary elevational views showing the pedals on one side of the machine in different operative positions.
Figure 3:
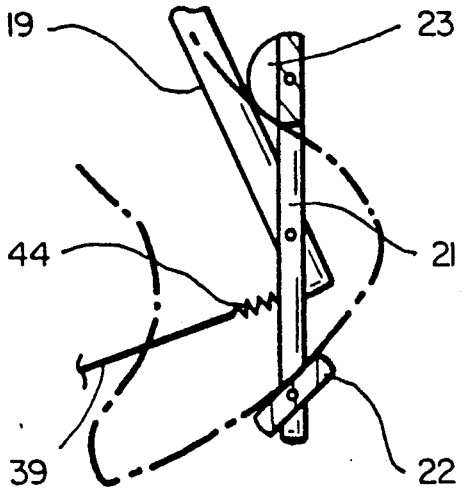

Pedal arms 21 are pivotally connected to the foot levers toward the free ends thereof, with a pair of pedals 22, 23 on each of the arms for engagement by the feet and legs of a person using the machine. The pedals located toward opposite ends of the arms, with the connection between the arms and the foot levers being located midway between the pedals. Pedals 22 are generally flat and rectangular and are adapted to be engaged by the bottoms of the feet. Pedals 23 are padded and are intended to be engaged by the backs of the legs as well as by the feet. FIG. 2 illustrates the bottom of a foot in engagement with both of the pedals, and FIG. 3 illustrates the bottom of the foot engaging pedal 22 and the back of the leg engaging pedal 23.

A seat 24 is mounted on rear post 17 for receiving the buttocks of a person using the machine. The seat has a depending stem 26 which is telescopically received in the post, with a pin 27 engageable with holes 28 spaced axially of the stem for adjusting the height of the seat.

A pair of vertically extending hand levers 31 is pivotally mounted on the frame for back and forth movement in a generally horizontal direction. The pivot axis for the hand levers is located at the lower ends of the levers and the front end of base member 12. Handlebars 32 extend from the upper ends of the hand levers and are adapted to be gripped by the hands of a person using the machine. The handlebars are telescopically received in the levers and can be set to any desired height, with pins 33 holding them in place.

Connecting rods or links 36 connect foot levers 19 and hand levers 31 together for movement in concert. The links are pivotally connected to the levers at points spaced from the pivot axes of the levers so that hand levers move forward as the foot levers move down and the hand levers move back as the foot levers move up. With the hand and foot levers linked together in this manner, a person using the machine is able to use his arms to resist movement of his legs and his legs to resist movement of his arms, and no flywheel or other energy absorbing wheel is required.

The two foot levers 19 are connected together by straps 38, 39 which are trained about pulleys 41, 42, with springs 43, 44 maintaining the straps in taut and in contact with the pulleys. Pulley 41 is rotatively mounted on a plate 46 which is affixed to the front portion of base member 12, and pulley 42 is rotatively mounted on a plate 47 which is affixed to the upper portion of rear post 17. The straps can be of any suitable type, including cables, belts and the like.

The straps serve two functions. They cause the levers on the two sides of the machine to move in opposite directions, and they also permit an adjustable mechanical resistance to be applied to the movement of the levers. The springs which maintain the straps taut also serve to absorb impact and provide a smoother transition as the direction of movement is reversed.

Figure 4:
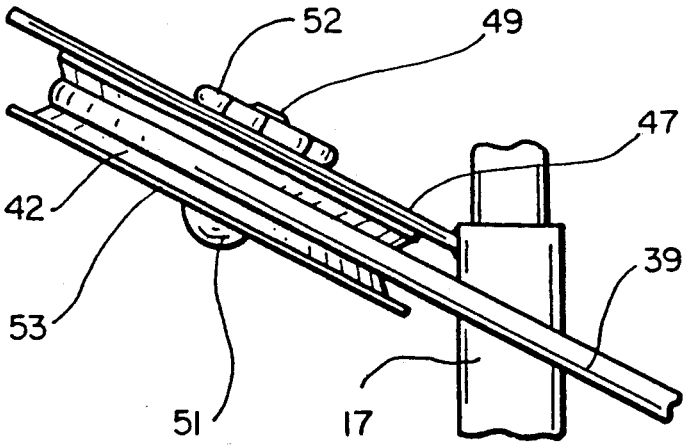
FIG. 4 is a fragmentary elevational view of a pulley and belt for resisting movement of the foot levers and arm levers in the embodiment of FIG. 1.

The manner in which the resistance is applied to the rear strap 39 is illustrated in FIG. 4, and a similar arrangement is provided for the front strap. Pulley 42 is mounted on an axle 49 which has an enlarged head 51 at one end and a nut 52 at the other. The axle passes through a friction plate or brake pad 53, the pulley and the mounting plate 47, and when the nut is tightened, the plate 53 is drawn into frictional engagement with the face of the pulley, thereby resisting rotation of the pulley and movement of the levers. The amount of resistance is dependent upon how much the nut is tightened and can be adjusted as desired.

The machine can be utilized in different ways depending upon the portion of the body to be exercised and the type of exercise desired. For a full body workout, for example, a person can stand on pedals 22, grasp handlebars 32 with his hands, pump the pedals with a downward motion, and pull back on the handlebars to resist movement of the pedals. If additional resistance is desired, one or both of the pulleys about which the straps are trained can be tightened. A similar but somewhat less demanding exercise can be done while sitting on the seat.

To exercise only the legs a person can sit on the seat and pump the pedals up and down, letting the hand levers go free and using one leg to resist movement of the other. This exercise can be done either with only the bottoms of the feet pushing down on pedals 22, as illustrated in FIG. 2, or with the bottoms of the feet pushing down on pedals 22 and the backs of the legs pulling up on pedals 23, as illustrated in FIG. 3, depending upon the muscles to be worked.

It is also possible to concentrate on exercising the arms by moving the handlebars back and forth with the arms and using the feet to resist this movement. As in all of the other exercises, one or both of the pulleys can be tightened to provide additional resistance, if desired.

The invention has a number of important features and advantages. It combines an up and down leg movement which closely approximates walking or climbing with a back and forth arm movement. It provides a full body workout and utilizes the exerciser's own body to provide resistance without a flywheel or other energy dissipating wheel.

It is apparent from the foregoing that a new and improved exercise machine has been provided. While only one presently preferred embodiment has been described in detail, as will be apparent to those familiar with the art, certain changes and modifications can be made without departing from the scope of the invention as defined by the following claims.

I claim:

1. In an exercise machine: a frame, a pair of foot levers pivotally mounted on the frame for up and down movement in a generally vertical direction, pedal arms pivotally connected to the lower portions of the foot levers, a pair of pedals on each of the arms spaced far enough apart that one of the pedals can be engaged by the bottom of the foot of a person using the machine for pushing down on the foot lever and the other pedal can be engaged by the back of the person's leg for pulling up on the foot lever, a pair of vertically extending hand levers pivotally mounted on the frame for back and forth movement in a generally horizontal direction, hand grips carried by the hand levers for engagement by the hands of the person using the machine, and a pair of connecting rods interconnecting respective ones of the foot levers and the hand levers for movement in concert so that the arms and the legs of the person using the machine can resist movement of each other.

2. The exercise machine of claim 1 including a strap interconnecting the leg levers and being trained about a pulley, and braking means engageable with the pulley for resisting movement of the levers.

3. The exercise machine of claim 2 wherein the braking means includes a brake pad and means for urging the brake pad into frictional engagement with the pulley with a force which can be adjusted to control the amount of resistance provided.

4. In an exercise machine: a frame, a pair of downwardly and rearwardly inclined foot levers pivotally mounted at their upper ends to the frame for up and down movement in a generally vertical direction, pedals mounted on the foot levers toward the free ends thereof for engagement by the feet of a person using the machine, a pair of vertically extending hand levers pivotally mounted at their lower ends to the frame for back and forth movement in a generally horizontal direction, handlebars toward the upper ends of the hand levers for engagement by the hands of the person using the machine, connecting rods interconnecting respective ones of the hand and foot levers for movement in concert, a pulley rotatively mounted on the frame, a strap trained about the pulley and connected to the two levers in one of the pairs to constrain the levers in the one pair for movement in opposite directions, and means for resisting rotation of the pulley to resist movement of the levers.

5. The exercise machine of claim 4 wherein the pedals are mounted on arms which are pivotally connected to the respective foot levers, together with additional pedals mounted on arms in spaced relation to the first named pedals for engagement by the feet and legs of the person using the machine.

6. The exercise machine of claim 4 further including a seat mounted on the frame to the rear of the foot levers and pedals for receiving the buttocks of the person using the machine.

7. The exercise machine of claim 4 wherein the means for resisting rotation of the pulley includes a brake pad and means for urging the brake pad into frictional engagement with the pulley with a force which can be adjusted to control the amount of resistance provided.

8. In an exercise machine: a frame having a longitudinally extending base member, a front post and a rear post extending in an upward direction from the base member, and a brace extending diagonally between the posts; a seat mounted on the rear post; a pair of foot levers pivotally mounted on the upper front portion of the frame and extending downwardly and rearwardly for up and down movement in a generally vertical direction; a pair of hand levers pivotally mounted on the lower portion of the frame in front of the front post for back and forth movement in a generally horizontal direction; and a pair of generally horizontally extending connecting rods connected between midpoints of respective ones of the foot levers and the hand levers so that the hand levers move forward as the foot levers move down and the arms and legs of a person using the machine can resist movement of each other.

9. The exercise machine of claim 8 including pedal arms pivotally connected to the lower portions of the foot levers, and a pair of pedals on each of the arms spaced far enough apart that one of the pedals can be engaged by the bottom of the foot of a person using the machine for pushing down on the foot lever and the other pedal can be engaged by the back of the person's leg for pulling up on the foot lever.

10. The exercise machine of claim 8 including a pulley rotatively mounted on the upper portion of the rear post, a strap trained about the pulley and connected to the lower portions of the foot levers coupling the two foot levers together for movement in opposite directions, and braking means engageable with the pulley for resisting movement of the levers.

11. The exercise machine of claim 10 wherein the braking means includes a brake pad and means for urging the brake pad into frictional engagement with the pulley with a force which can be adjusted to control the amount of resistance provided.

12. The exercise machine of claim 10 including a second pulley rotatively mounted on the lower front portion of the frame, and a second strap trained about the second pulley and connected to the foot levers.

* * * * *